US006026966A

United States Patent [19]

Svoboda

[11] Patent Number: 6,026,966

[45] Date of Patent: Feb. 22, 2000

[54] FERROHYDROSTATIC SEPARATION METHOD AND APPARATUS

[76] Inventor: Jan Svoboda, 158 Cornelis Street, Fairland, Johannesburg, South Africa

[21] Appl. No.: 08/959,826

[22] Filed: Oct. 29, 1997

[30] Foreign Application Priority Data

Nov. 5, 1996 [ZA] South Africa ..... 96/9288

[51] Int. Cl.[7] ..... B03B 5/28; B03B 5/30

[52] U.S. Cl. ..... 209/172.5; 209/172

[58] Field of Search ..... 209/1, 40, 454, 209/172.5, 478, 214, 215, 223.1, 224

[56] References Cited

U.S. PATENT DOCUMENTS

| | | | |
|---|---|---|---|
| 3,483,968 | 12/1969 | Kaiser | 209/1 |
| 3,483,969 | 12/1969 | Rosenwig | 209/1 |
| 3,788,465 | 1/1974 | Reimers et al. | 209/1 |
| 3,951,785 | 4/1976 | Kaiser | 209/1 |
| 4,521,303 | 6/1985 | Hicks et al. | 209/454 |
| 4,526,681 | 7/1985 | Friedlaender et al. | 209/214 |
| 5,169,517 | 12/1992 | Buisson et al. | 209/20 |
| 5,316,151 | 5/1994 | Thompson | 209/223.1 |
| 5,356,015 | 10/1994 | Notebaart et al. | 209/214 |
| 5,370,993 | 12/1994 | Tarnowski | 209/214 |
| 5,762,204 | 8/1975 | Kaiser | 209/1 |
| 5,868,939 | 2/1999 | Oder et al. | 210/695 |

*Primary Examiner*—Donald P. Walsh
*Assistant Examiner*—Daniel K Schlak
*Attorney, Agent, or Firm*—Akin, Gump, Strauss, Hauer & Feld, L.L.P.

[57] ABSTRACT

The invention concerns a ferrohydrostatic separation method in which the apparent density of a ferrofluid used to separate materials according to density is controlled by a magnetic field generated by a solenoid.

15 Claims, 2 Drawing Sheets

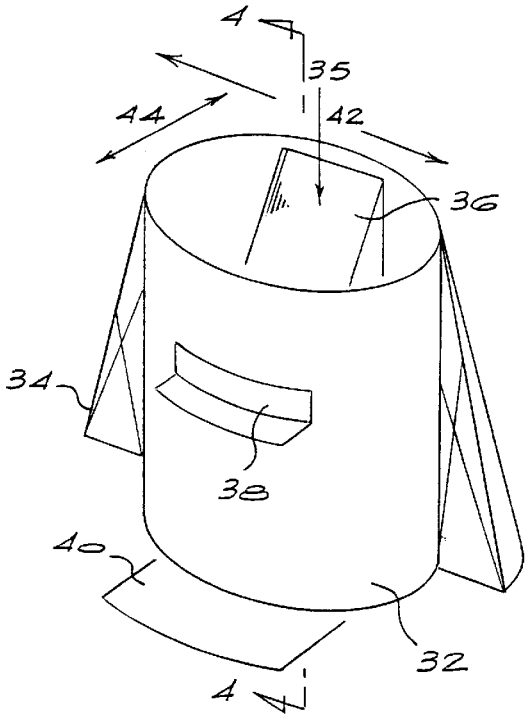
FIG 3
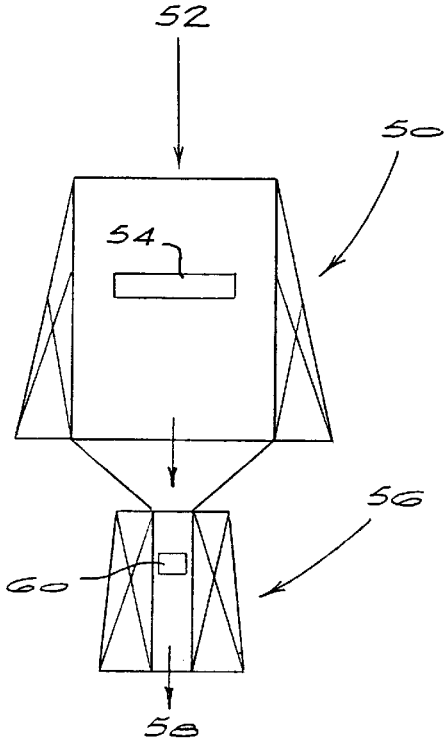
FIG 5
FIG 4
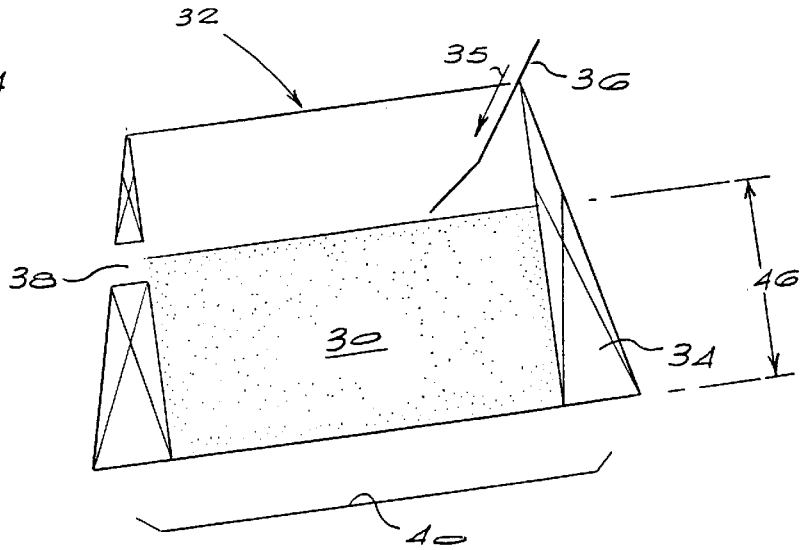

FERROHYDROSTATIC SEPARATION METHOD AND APPARATUS

BACKGROUND TO THE INVENTION

This invention relates to a ferrohydrostatic (FHS) separation method and apparatus.

As defined in the specification of U.S. Pat. No. 3,483,969, a ferrofluid is a material comprising a permanent, stable suspension of ferromagnetic material in a suitable liquid carrier. A common ferrofluid comprises fine particles (typically $10^{-9}$ m or less in size) of magnetite in a liquid. In this case, the extremely fine nature of the particles maintains them indefinitely in suspension without sinking or agglomerating.

The use of a ferrofluid to separate materials of different densities, referred to in the art as ferrohydrostatic separation, is also known and is, for instance, described in the specification of U.S. Pat. No. 3,483,969. The materials which are to be separated can be solid particulate materials or liquids which are immiscible with the carrier liquid of the ferrofluid. In essence, the separation process involves applying a magnetic field to the ferrofluid with a view to controlling the apparent density of the ferrofluid within close limits. The materials which are to be separated are then deposited in the ferrofluid, with the result that those materials which have a density exceeding the controlled apparent density of the ferrofluid will sink in the ferrofluid while those which have a density less than that of the ferrofluid will float in the ferrofluid. The sink and float fractions can then be recovered separately.

In all known prior art FHS separators using ferrofluids, the required magnetic field is generated by means of electromagnets or permanent magnets with an iron yoke, with the ferrofluid situated between the pole tips of the magnet. This has a number of significant disadvantages which may be summarised as follows:

1. In order to ensure that the FHS process operates with a well-defined cut point it is essential that the pole tips of the magnet be carefully designed to produce a constant magnetic field gradient in the working space between the pole tips. This can be difficult to achieve even with complicated mathematical models, because of the non-linear magnetic behaviour of iron. As a result it is generally only possible to achieve an approximately constant magnetic field gradient in the ferrofluid.
2. In order to achieve a magnetic field across a suitably large volume to enable the FHS technique to be used for large throughputs, it is necessary to increase the gap between the pole tips of the magnet. This in turn results in an enormous and uneconomical increase in the volumes of iron and copper required to construct the magnet and, in general, in the overall size and mass of the separation apparatus.
3. In the conventional iron yoke magnets the magnetic field strength across the air gap between the yoke tips is non-homogeneous. This means that only a central region of the air gap can usefully be employed in the FHS technique.

SUMMARY OF THE INVENTION

According to the present invention the apparent density of the ferrofluid used in an FHS technique is controlled by a magnetic field generated by a solenoid. The required constant magnetic field gradient, in a vertical direction, is achieved by a non-uniform solenoid winding, multiple windings or by varying the current density at different positions in the winding.

The solenoid may, if required, be clad with an iron return frame.

The use of a solenoid has many advantages compared to the use of an iron yoke electromagnet or permanent magnet, as follows:

1. With a solenoid, it is possible to generate an equivalent magnetic field to that generated by an iron yoke magnet, in the same space, with a far more compact design which requires less iron and copper material. A particularly compact solenoid design is possible if the solenoid is clad with an iron return frame, as mentioned above.
2. Whereas it is necessary with an iron yoke magnet to increase the air gap in order to achieve an increase in throughput of material which is to be separated, with the attendant disadvantages mentioned above, with a solenoid it is possible to increase the throughput merely by increasing the relevant transverse dimension of the solenoid, the axial length of the air gap remaining constant. Because the number of ampereturns required to generate a given magnetic field is dependent on the length of the air gap a solenoid can be scaled up to any required, practical size and still have the number of ampereturns constant.
3. With a solenoid it is possible to design the magnetic field pattern in a simple and highly accurate manner. This facilitates the provision of a magnetic field gradient which is constant, thereby enabling close control to be maintained over the apparent density of the ferrofluid and accordingly over the cut point which is achieved in the FHS separator. As mentioned above, this can, for instance, be achieved by precisely designing the winding of the solenoid, by varying the current density at different positions in the winding or by using a multiple winding arrangement.
4. The magnetic field across the transverse dimension of a solenoid is homogeneous, which means that the same, constant apparent density of ferrofluid can be achieved across the full transverse dimension. Thus the entire transverse dimension can be used for separation and the overall design is accordingly more efficient and compact.
5. Because of the relatively small mass and size of a solenoid compared to an iron-yoke magnet capable of generating an equivalent magnetic field, it is possible to arrange two or more FHS separation units in to provide for multi-stage separation, as described below in more detail.

Further according to the invention there is provided a method of separating materials of different density, the method comprising introducing the materials into a ferrofluid, using a solenoid about the ferrofluid to generate a magnetic field which controls the apparent density of the ferrofluid to a value between the densities of the materials, and separately recovering from the ferrofluid materials which sink and float therein.

Still further according to the invention there is provided a ferrohydrostatic separation apparatus for separating materials having different densities, the apparatus including a separation chamber for accommodating a ferrofluid into which the materials can be introduced, and a solenoid about the chamber for generating a magnetic field to control the apparent density of the ferrofluid.

Other features of the invention are set forth in the appended claims.

BRIEF DESCRIPTION OF THE DRAWINGS

The invention will now be described in more detail, by way of example only, with reference to the accompanying drawings in which:

FIG. 3 diagrammatically illustrates an FHS separator according to the present invention which can be used for continuous separation of materials of different density;

FIG. 4 shows a diagrammatic cross-section at the line 4—4 in FIG. 3; and FIG. 5 diagrammatically illustrates a multi-stage FHS separator according to the present invention.

DESCRIPTION OF EMBODIMENTS OF THE INVENTION

Figure 1:
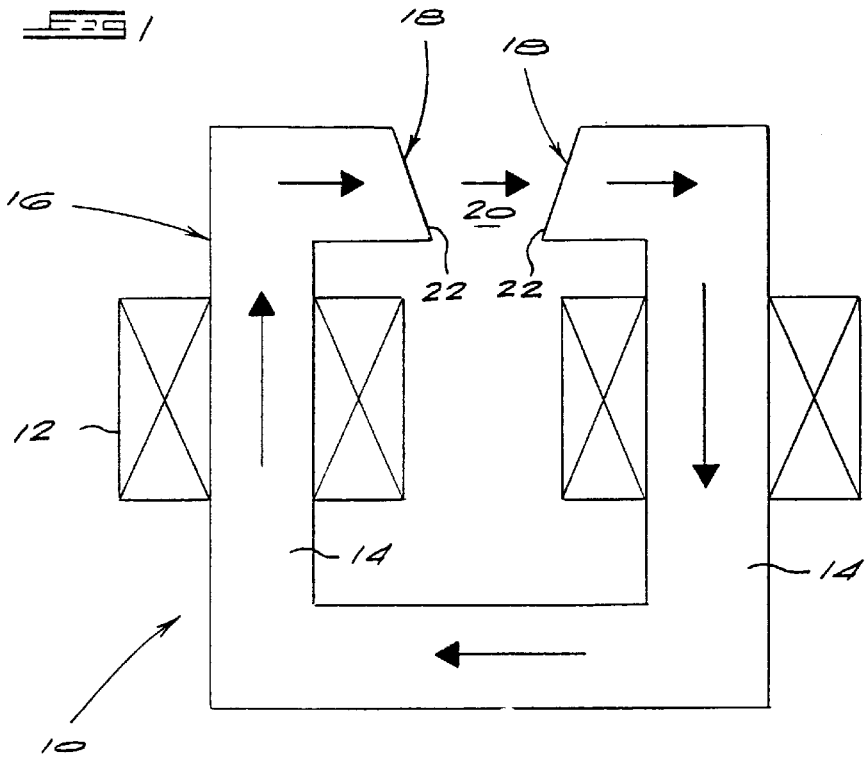
FIG. 1 diagrammatically illustrates a conventional FHS separator using an iron-yoke electromagnet.

FIG. 1 shows an electromagnet 10 which includes windings 12 arranged about the limbs 14 of an iron yoke 16 having pole tips 18. A working space 20 is defined between the pole tips 16.

In a conventional FHS separation system employing a magnet 10 of this type a ferrofluid, typically a suspension of fine magnetite particles in stable suspension in a suitable liquid will be located in the working space 20 between the pole tips and is held in place by the magnetic field generated by the magnet. The apparent density of the ferrofluid is controlled, to a desired value, by ensuring that the magnetic field gradient, in the vertical direction, is kept at least approximately constant. The surfaces 22 of the pole tips must be carefully designed to ensure that a magnetic field gradient which is as constant as possible is generated in the ferrofluid.

Materials which are to be separated into fractions of different density respectively greater and less than the controlled apparent density of the ferrofluid are introduced into the ferrofluid, with the result that the denser particles sink while the less dense particles float.

Figure 2:
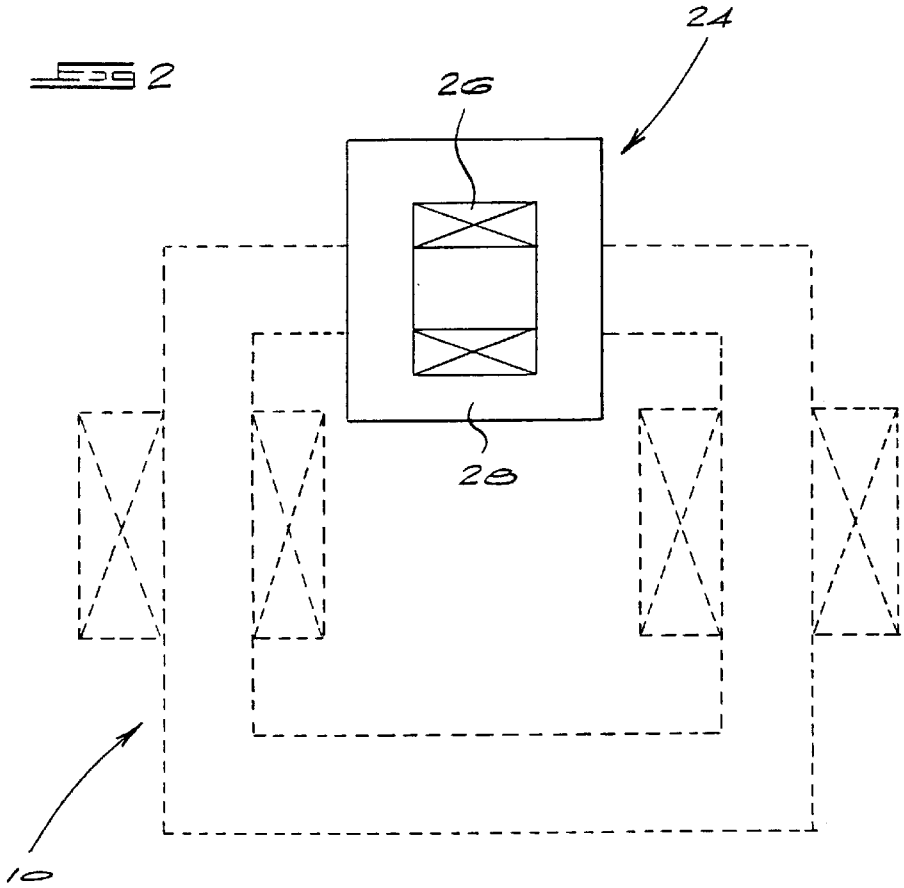
FIG. 2 diagrammatically illustrates the compactness of a solenoid-based FHS separator according to the invention compared to the conventional FHS separator of FIG. 1.

The present invention proposes that the conventional iron yoke magnet be replaced by a solenoid. FIG. 2 diagrammatically illustrates a typical size comparison between the conventional magnet 10 and a solenoid 24 which is capable of generating an equivalent magnetic field and the windings of which are designated with the numeral 26.

For purposes of comparison, the solenoid is shown in FIG. 2 with a horizontal axis, but it will be understood that in practice, the axis of the solenoid will be vertical.

It will also be noted that in FIG. 2 the solenoid 24 is illustrated with an iron return frame 28 located about the windings 26. From the comparison diagrammatically represented in FIG. 2 it will readily be appreciated that an FHS separator making use of a solenoid, in accordance with the invention, is far less bulky and uses far less material than an FHS separator making use of an equivalent iron yoke magnet. It will also be apparent from the comparison in FIG. 2 that scaling up a solenoid based FHS separator, to allow for material separation in a larger working space 20, can be achieved far more readily than in the case of the iron yoke magnet.

FIGS. 3 and 4 diagrammatically illustrate an embodiment of FHS separator, according to the invention, which is capable of continuously separating materials at a high throughput rate. In this embodiment, a ferrofluid 30, once again typically a stable suspension of very fine magnetite particles in a suitable liquid, is accommodated in a separation chamber 32.

The numeral 34 indicates a non-uniform solenoid winding which surrounds the chamber 32 and which is carefully designed to produce the constant magnetic field gradient in the ferrofluid which is required to maintain the apparent density of the ferrofluid at a selected value between the densities of the materials which are to be separated.

The iron return frame referred to previously is omitted from FIGS. 3 and 4 in the interests of clarity.

As shown in FIG. 4, the separation chamber 32 is inclined relative to the horizontal, and the body of ferrofluid 30, held in position by the applied magnetic field, has a similar inclination. Feed material 35, composed of solid particulate materials which are to be separated from one another, is introduced into the ferrofluid 30 by means of a feeder 36, in this case a vibratory feeder.

The particles in this embodiment will typically have a size of $+100\times10^{-6}$ m. Those particles which have a density less than the apparent density of the ferrofluid will float in the ferrofluid and report to an elevated float outlet 38, from which they can be removed. Those particles which have a density greater than the apparent density of the ferrofluid will sink through the ferrofluid and report to a sink collecting chute 40 which removes them. It will be recognized that the outlet 38 is created by an appropriate gap in the solenoid winding 34. The FHS separation process accordingly operates continuously with the sink and float fractions being removed separately from the separation chamber.

The separation chamber 32 and the solenoid winding may have a circular or other shape. The chamber and winding preferably have an oblong shape which is, in the illustrated case, elliptical. The major axis 42 of the ellipse is substantially longer than the minor axis 44 thereof. For a given rate of transverse movement of the particles, only a certain distance, i.e. the length of the minor axis, is required to ensure thorough separation of the float and sink fractions. The major axis may be made as long as practically feasible to give the required throughput. Also, the vertical dimension 46 of the separation chamber, i.e. the vertical dimension of the body of ferrofluid, can be kept as low as is necessary for proper separation of the sink and float fractions. Thus the dimensions 44 and 46 determine the residence time of the particles in the ferrofluid and hence the efficiency with which the sink and float fractions are separated while the dimension 42 determines the throughput. In a typical example, the dimension 44 may be 400 mm, the dimension 46 200 mm and the dimension 42 one metre or more.

Although FIGS. 3 and 4 show an FHS separator operating with a single cut point, i.e. a single apparent density of the ferrofluid, which enables a single separation to be made between particles of greater and lesser density, it is believed that it will be possible, with appropriate design of the solenoid winding, to achieve several cut points. This could for instance be achieved with multiple solenoid windings and/or by varying the current supplied to the winding(s) at different vertical positions. With such arrangements, it is envisaged that it will be possible to separate a feed material simultaneously into three or more fractions consisting of float, middlings and sink fractions. The float and middlings fraction(s) will each be withdrawn through separate outlets at different elevations.

Separation into a greater number of fractions can also be achieved with a multi-stage arrangement, an example of which is illustrated diagrammatically in FIG. 5. In this case, a first FHS separator 50, operating in the manner described above for FIG. 3, separates feed material 52 into a float fraction which is withdrawn through an elevated outlet 54 and a sink fraction which forms the feed for a second FHS separator 56. The second separator also operates in the same manner, but in this case the cut point is controlled, by the design of the solenoid winding, between less dense and more dense particles contained in the feed supplied as the sink fraction from the first separator. Thus in this case, the densest particles are recovered as the sink 58 from the second separator and particles of intermediate density are recovered as middlings through an outlet 60. It will be appreciated that a multi-stage arrangement as exemplified in FIG. 5 could have three or even more FHS separators arranged in series to separate the initial feed material into a greater number of fractions.

In each case, the accuracy with which the solenoid windings can be designed to produce a desired magnetic field gradient, and hence the close control which can be maintained over the apparent density of the ferrofluid, will enable separation to be achieved between particles which have densities that are very close to one another.

Kerosene will most commonly be used as the liquid carrier of a ferrofluid which has magnetite particles in suspension, but water may be preferred in some cases.

I claim:

1. A method of separating materials having different densities, the method comprising the steps of:

introducing the materials to be separated into a ferrofluid;

using a solenoid for generating a magnetic field around the ferrofluid to control the apparent density of the ferrofluid to be at a value between the densities of the materials; and separately, recovering from the ferrofluid materials which sink and float therein.

2. A method according to claim 1 wherein the solenoid has a non-uniform winding to generate a required magnetic field.

3. A method according to claim 1 wherein the solenoid has multiple windings to generate a required magnetic field.

4. A method according to claim 1 wherein the winding of the solenoid is supplied with varying current densities at different positions to generate a required magnetic field.

5. A method according to claim 1 wherein the ferrofluid is accommodated in a separation chamber of oblong shape and the materials which are to be separated are caused to move in the ferrofluid in a direction aligned with the minor dimension of the oblong shape.

6. A ferrohydrostatic separation apparatus for separating materials having different densities, the apparatus including a separation chamber for accommodating a ferrofluid into which the materials can be introduced, and a solenoid around the chamber for generating a magnetic field to control the apparent density of the ferrofluid to be at a value between the densities of the materials.

7. A ferrohydrostatic separation apparatus according to claim 6 wherein the solenoid has a non-uniform winding to generate a required magnetic field.

8. A ferrohydrostatic separation apparatus according to claim 6 wherein the solenoid has multiple windings to generate a required magnetic field.

9. A ferrohydrostatic separation apparatus according to claim 6 wherein the solenoid is clad in an iron return frame.

10. A ferrohydrostatic separation apparatus according to claim 6 wherein the separation chamber has an oblong shape and the apparatus is arranged for the materials to move in the ferrofluid in a direction aligned with the minor dimension of the oblong shape.

11. A ferrohydrostatic separation apparatus according to claim 10 wherein the separation chamber and solenoid are arranged for the surface of ferrofluid in the chamber to be inclined to the horizontal across the minor dimension of the oblong shape.

12. A ferrohydrostatic separation apparatus according to claim 10 comprising a feeder aligned with the minor dimension of the oblong shape for introducing the materials into the ferrofluid.

13. A ferrohydrostatic separation apparatus according to claim 10 wherein the separation chamber has an elliptical shape.

14. A ferrohydrostatic separation apparatus according to claim 6 wherein the separation chamber includes a first outlet, at a relatively high level, through which material having a density less than the apparent density of the ferrofluid can leave the chamber and a second outlet, at a relatively low level, through which material having a density greater than the apparent density of the ferrofluid can leave the chamber.

15. A ferrohydrostatic separation apparatus according to claim 14 comprising at least two separation chambers arranged in series such that material leaving a chamber through a second outlet thereof is introduced into the next succeeding chamber.

* * * * *